US005692947A

United States Patent [19]

Talieh et al.

[11] Patent Number: 5,692,947

[45] Date of Patent: Dec. 2, 1997

[54] LINEAR POLISHER AND METHOD FOR SEMICONDUCTOR WAFER PLANARIZATION

[75] Inventors: Homayoun Talieh, Santa Clara County; David Edwin Weldon, Santa Cruz County, both of Calif.

[73] Assignee: OnTrak Systems, Inc., San Jose, Calif.

[21] Appl. No.: 759,172

[22] Filed: Dec. 3, 1996

Related U.S. Application Data

[63] Continuation of Ser. No. 287,658, Aug. 9, 1994, abandoned.

[51] Int. Cl.[6] ..... B24B 1/00

[52] U.S. Cl. ..... 451/41; 451/307; 451/443; 451/60; 451/173; 125/21

[58] Field of Search ..... 451/41, 60, 173, 451/307, 443

[56] References Cited

U.S. PATENT DOCUMENTS

| | | | |
|---|---|---|---|
| 619,399 | 2/1899 | Fischer | 451/163 |
| 3,447,306 | 6/1969 | Jakimcius | 451/544 |
| 3,654,739 | 4/1972 | Stoy et al. | 51/141 |
| 3,753,269 | 8/1973 | Budman | 451/444 |
| 3,906,678 | 9/1975 | Roth | 51/154 |
| 4,016,857 | 4/1977 | Hall | 125/21 |
| 4,347,689 | 9/1982 | Hammond | 451/307 |
| 4,416,090 | 11/1983 | Jonasson | 51/138 |
| 4,593,495 | 6/1986 | Kawakami et al. | 51/118 |
| 4,628,640 | 12/1986 | Johannsen | 51/141 |
| 4,642,943 | 2/1987 | Taylor, Jr. | 51/135 R |
| 4,704,823 | 11/1987 | Steinback | 51/110 |

(List continued on next page.)

FOREIGN PATENT DOCUMENTS

| | | |
|---|---|---|
| 517 594 | 12/1992 | European Pat. Off. . |
| 517 595 | 12/1992 | European Pat. Off. . |
| 3411 120 A1 | 3/1983 | Germany . |
| 59-232768 | 12/1984 | Japan . |
| 62-162466 | 7/1987 | Japan . |
| 63-200965 | 8/1988 | Japan . |
| 63-251166 | 10/1988 | Japan . |
| 63-267155 | 11/1988 | Japan . |
| 2269552 | 11/1990 | Japan . |
| 2269553 | 11/1990 | Japan . |
| 4-250967 | 9/1992 | Japan . |
| 7111256 | 4/1995 | Japan . |
| 2007784 | 2/1994 | U.S.S.R. . |
| WO 94/17957 | 8/1994 | WIPO . |

OTHER PUBLICATIONS

"A New Pad and Equipment Development for ILD Planarization" by Toshiyasu Beppu, Motoyuki Obara and Yausuo Minamikawa, Semiconductor World, Jan., 1994, MY Mar. 17, 1994.

"Application of Chemical Mechanical Polishing to the Fabrication of VLSI Circuit Interconnections", William J. Patrick, William L. Guthrie, Charles L. Stadley and Paul M. Schiable, J. Electrochem. Soc., vol. 138, No. 6, Jun. 1991, pp. 1778–1784.

"Theory & Practice of Lubrication for Engineers", Dudley Fuller, Wiley–Interscience, 1st ed., pp. 22–25 and 86.

Practical Ideas, Jun. 1994, p. 67.

*Primary Examiner*—Robert A. Rose
*Assistant Examiner*—George Nguyen
*Attorney, Agent, or Firm*—Brinks Hofer Gilson & Lione

[57] ABSTRACT

A wafer polisher and method for the chemical mechanical planarization of semiconductor wafers. The polisher includes a wafer holder for supporting the semiconductor wafer and a linear polishing assembly having a polishing member positioned to engage the surface of the wafer. The polishing member is movable in a linear direction relative to the wafer surface to uniformly polish the surface of the wafer. A pivotal alignment device may be used to pivotally support one of the wafer holder and the polishing member relative to the other of the wafer holder and the polishing member with the surface of the wafer and the polishing member retained in parallel alignment during operation of the polisher. The polisher optionally includes a conditioning station for conditioning the polishing member.

10 Claims, 7 Drawing Sheets

U.S. PATENT DOCUMENTS

| | | | |
|---|---|---|---|
| 4,811,522 | 3/1989 | Gill, Jr. | 51/314 |
| 4,934,102 | 6/1990 | Leach et al. | 51/50 |
| 4,941,293 | 7/1990 | Ekhoff | 451/63 |
| 5,081,795 | 1/1992 | Tanaka et al. | 51/131.1 |
| 5,205,082 | 4/1993 | Shendon et al. | 51/283 R |
| 5,212,910 | 5/1993 | Breivogel | 51/398 |
| 5,230,184 | 7/1993 | Bukhman | 51/283 R |
| 5,232,875 | 8/1993 | Tuttle et al. | 451/63 |
| 5,246,525 | 9/1993 | Sato | 156/345 |
| 5,274,964 | 1/1994 | Simpson et al. | 451/444 |
| 5,276,999 | 1/1994 | Bando | 51/62 |
| 5,287,663 | 2/1994 | Pierce et al. | 51/401 |
| 5,297,361 | 3/1994 | Baldy et al. | 51/119 |
| 5,329,732 | 7/1994 | Karlsrud et al. | 51/131.5 |
| 5,329,734 | 7/1994 | Yu | 51/283 R |
| 5,335,453 | 8/1994 | Baldy et al. | 51/67 |
| 5,399,125 | 3/1995 | Dozier | 474/117 |
| 5,456,627 | 10/1995 | Jackson et al. | 451/63 |

10
12
14
16
18
20
22
24
26
28
34
36
40
42
46
48
50
8
9
A

LINEAR POLISHER AND METHOD FOR SEMICONDUCTOR WAFER PLANARIZATION

This application is a continuation of application Ser. No. 08/287,658, filed Aug. 9, 1994, now abandoned.

BACKGROUND OF THE INVENTION

This invention relates in general to a system for chemical mechanical polishing of semiconductor wafers. More particularly, the present invention relates to a linear polisher for the chemical mechanical planarization of semiconductor wafers.

The available systems for the chemical mechanical planarization of semiconductor wafers typically employ a rotating wafer holder for supporting the wafer and a polishing pad which is rotated relative to the wafer surface. The wafer holder presses the wafer surface against the polishing pad during the planarization process and rotates the wafer about a first axis relative to the polishing pad. The polishing pad is carried by a polishing wheel or platen which is rotated about a second axis different from the rotational axis of the wafer holder. A polishing agent or slurry is applied to the polishing pad to polish the wafer. As the wafer holder and the polishing wheel are each rotated about their respective central axes, an arm moves the wafer holder in a direction parallel to the surface of the polishing wheel.

Since the polishing rate applied to the wafer surface is proportional to the relative velocity of the polishing pad, the polishing rate at a selected point on the wafer surface depends upon the distance of the selected point from the axis of rotation. Thus, the polishing rate applied to the edge of the wafer closest to the rotational axis of the polishing pad is less than the polishing rate applied to the opposite edge of the wafer. Rotating the wafer throughout the planarization process averages the polishing rate applied across the wafer surface so that a uniform average polishing rate is applied to the wafer surface. Although the average polishing rate may be uniform, the wafer surface is continuously exposed to a variable polishing rate during the planarization process.

Although the polishing rate is generally proportional to the relative velocity of the polishing pad, other factors as for example fluid dynamic and thermodynamic effects on the chemical reactions occurring during the planarization process influence the actual polishing rate at any given instant in time. These effects are not uniform across the wafer surface during the planarization process. Moreover, instead of "averaging" the effects, the relative rotation of the wafer and the polishing pad contribute to the fluid dynamics and thermodynamics of the reaction.

After a period of time, the polishing pad becomes saturated with deactivated slurry, loose particles, etc. The pad must be frequently roughened to remove such particles from the polishing surface of the pad. For example, a scraping tool is typically mounted in contact with the polishing pad to scrape the loose slurry from the pad surface.

Because of advances in wafer processing technology and semiconductor component structure, uniformly polishing or planarizing a film on the surface of the wafer has become increasingly important. For example, integrated circuits such as microprocessors, controllers and other high performance electronic logic devices have become increasing complex while the size of such devices has decreased substantially. With the multiple wiring layers employed in complex devices, a significant component of the delay in signal propagation is due to the interconnections between the multiple layers. Several multilevel interconnection processes are being developed to reduce the delays associated with interconnect resistance, such as smaller wiring geometry and the use of copper or other materials as interconnect metals. However, the surface of the semiconductor wafer is generally rough. Each wiring layer provides additional circuitry components which project from the wafer surface, producing a rippled effect on the surface of the device. When several layers are formed on the wafer, the uneven topography of the device becomes more exaggerated. Even if the first layer is completely planar, circuitry components of the succeeding layers often produce a rippled effect which must be planarized.

This invention provides a system for uniformly polishing the surface of a semiconductor wafer. The system includes a linear polisher which applies a uniform polishing rate across the wafer surface throughout the planarization process for uniformly polishing the film on the surface of the semiconductor wafer. The polisher is of simplified construction, thereby reducing the size of the machine and making the polisher suitable for even larger-diameter wafers. For example, the linear polisher is approximately ⅕ the size of available machines. The reduced size and simplicity of the machine substantially reduces the manufacturing costs of the polisher. Since less space is required for the polisher, the operation costs are also substantially reduced. Although the overall size may vary, the linear polisher may be only slightly larger than the wafer. The polisher of the invention may have one or more conditioning stations for roughing or conditioning the polishing member during the polishing cycle, ensuring that a uniform polishing rate is applied to the wafer surface throughout the planarization process.

SUMMARY OF THE INVENTION

In summary, the present invention provides a system for the chemical mechanical planarization of semiconductor wafers. The system includes a wafer polishing machine having a linear polisher and a wafer support assembly for holding a semiconductor wafer. The linear polisher includes a polishing pad positioned to engage the wafer surface. The polishing pad is moved in a linear direction relative to the wafer for uniformly planarizing the surface of the wafer. The wafer polishing machine may also include a pivotal alignment device positioned to pivotally support either the wafer holder or the polishing pad so that the wafer surface and the polishing pad are retained in parallel alignment during operation of the polishing machine.

In one embodiment of the invention, the polishing pad is movable in a continuous path during which the polishing pad passes across the surface of the wafer. The wafer polishing machine further includes a conditioning station positioned in the path of the polishing pad for conditioning the pad during operation of the polishing machine.

The system of the invention also includes a method for uniformly polishing the surface of a semiconductor wafer. The method includes the steps of supporting the wafer with the surface of the wafer engaging the polishing pad and moving the polishing pad in a linear direction relative to the wafer to apply a uniform polishing force across the wafer surface.

BRIEF DESCRIPTION OF THE DRAWINGS

Additional objects and features of the invention will be more readily apparent from the following detailed description and appended claims when taken in conjunction with the drawings, wherein:

DESCRIPTION OF THE PREFERRED EMBODIMENTS

Figure 1:
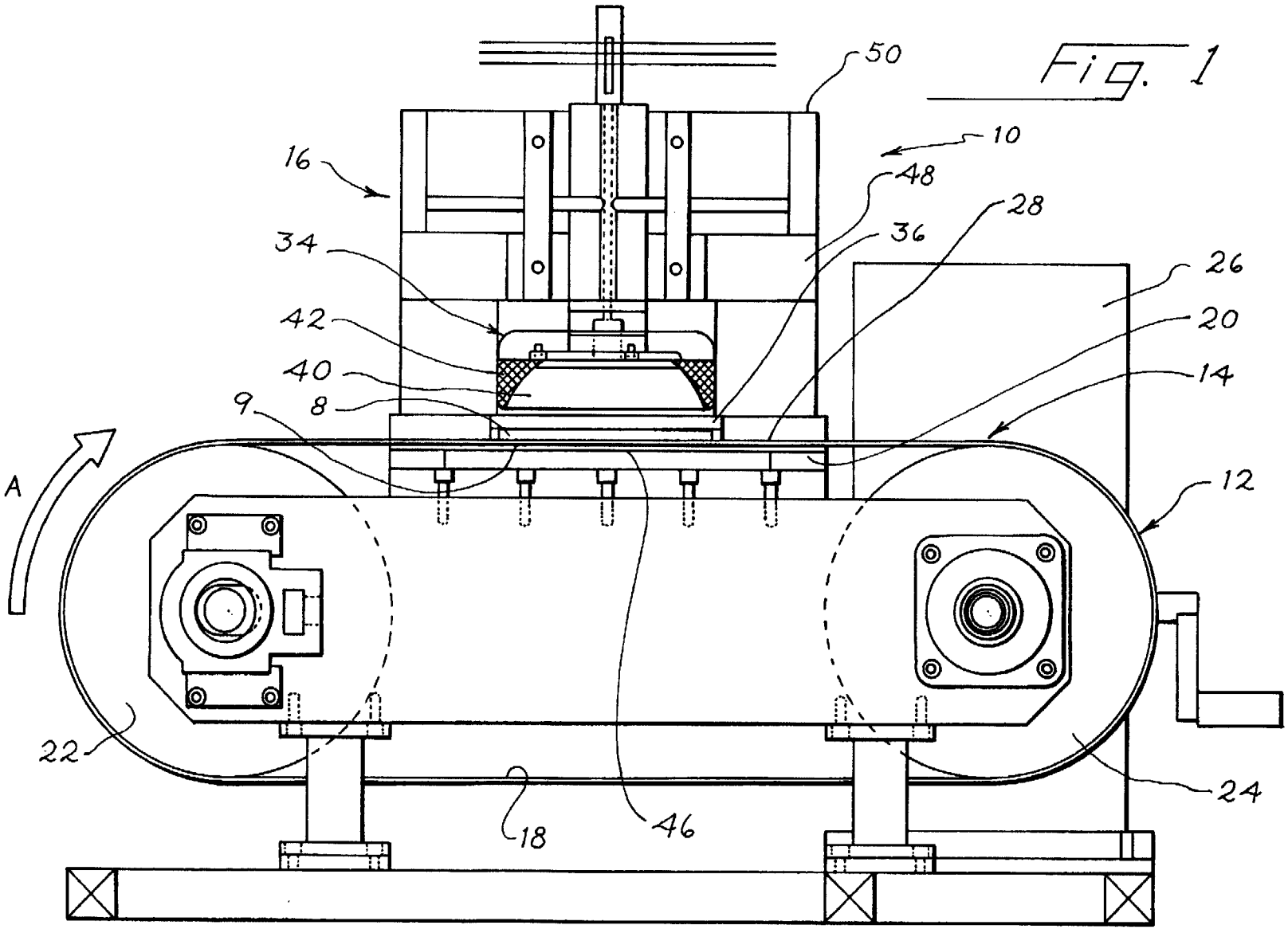
FIG. 1 is front plan view of a wafer polishing machine in accordance with the invention.

Reference will now be made in detail to the preferred embodiment, which is illustrated in the accompanying figures. Turning now to the drawings, wherein like components are designated by like reference numerals throughout the various figures, attention is directed to FIGS. 1–3.

Figure 2:
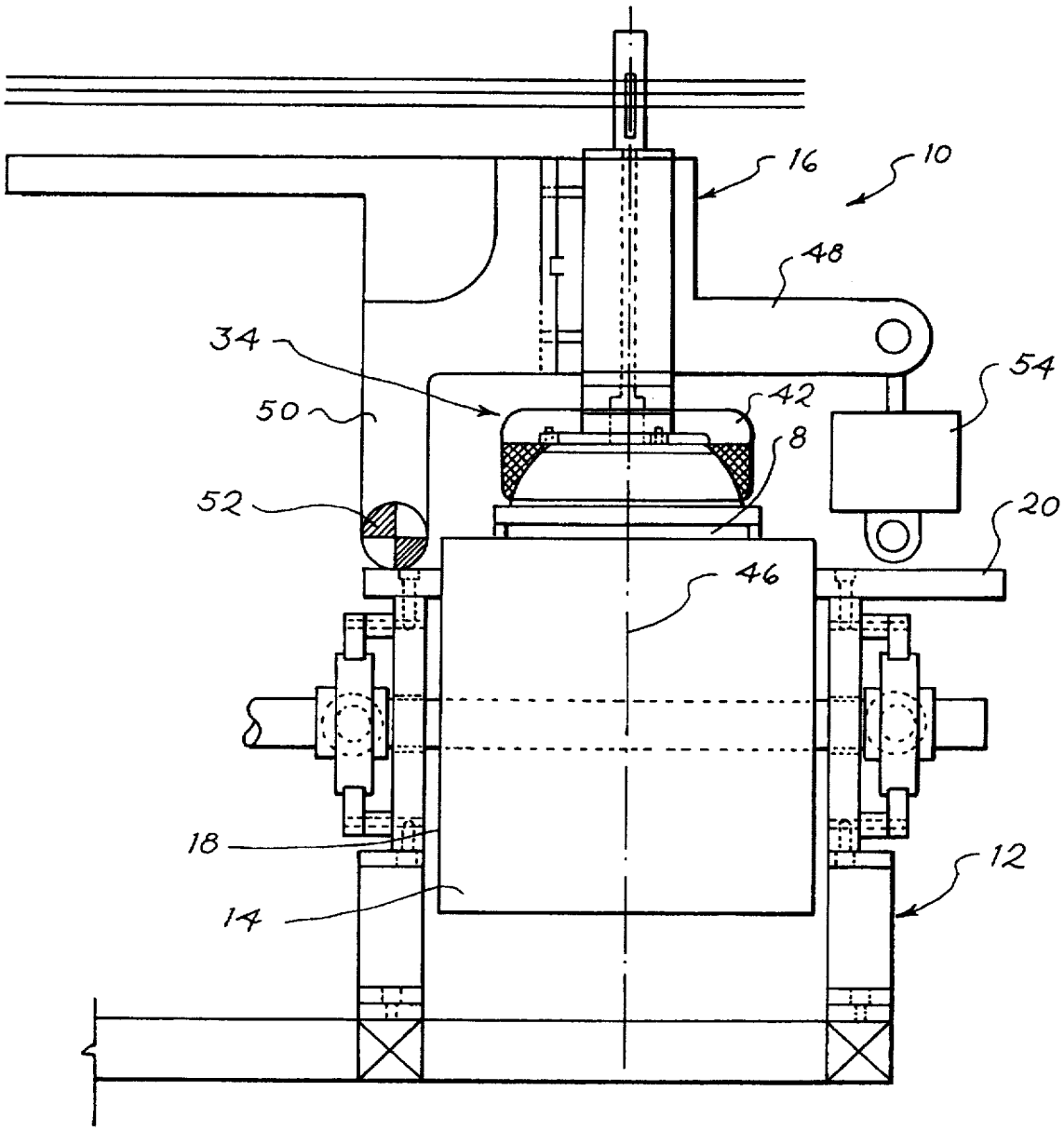
FIG. 2 is a side plan view, partially broken away, of the wafer polishing machine of FIG. 1.
Figure 3:
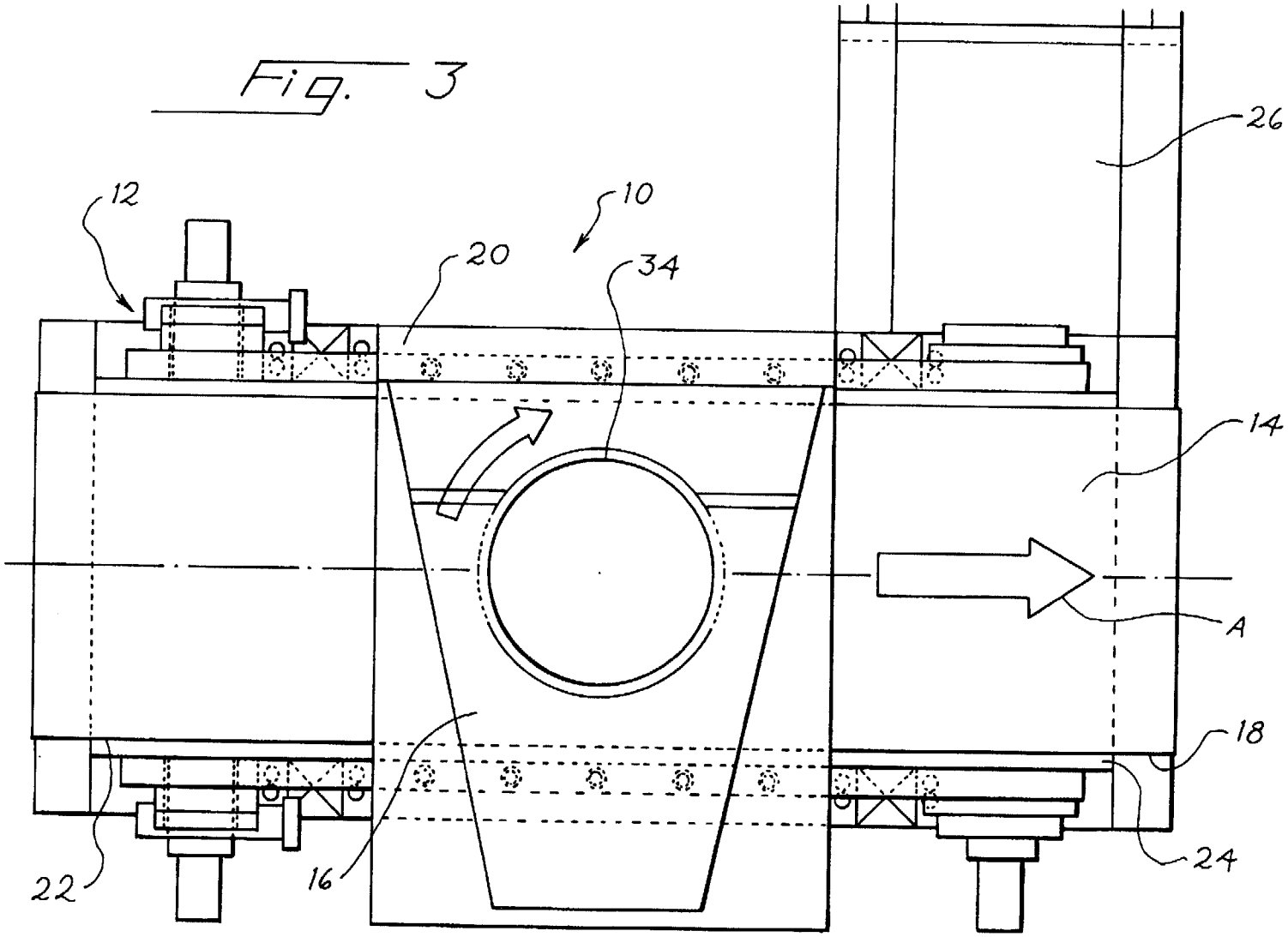
FIG. 3 is a top plan view of the wafer polishing machine of FIG. 1.

A wafer polishing machine 10 for uniformly planarizing the surfaces of a semiconductor wafer 8 is shown in FIGS. 1–3. The polishing machine 10 generally includes a linear polisher 12 having a polishing member or polishing pad 14 for polishing the surface 9 of the semiconductor wafer 8 and a support assembly 16 for supporting the semiconductor wafer during the polishing operation. A polishing agent or slurry (not shown) such as a colloidal silica or fumed silica slurry is deposited on the polishing member to polish the wafer surface. Alternatively, the polishing member 14 may be provided by a pad impregnated with an abrasive polishing agent. The linear polisher 12 moves the polishing pad 14 in a linear direction relative to the semiconductor wafer 8 to continuously provide a uniform polishing force across the entire surface of the wafer. Preferably, the polishing member 14 is moved at a constant velocity although in some applications it may be desirable to employ a specific variable velocity profile to polish the wafer surface. The linear, constant velocity motion of the polishing member 14 provides superior polishing uniformity across the wafer surface.

In the embodiment of the linear polisher 12 shown in FIGS. 1–3, the polishing member or pad 14 is mounted to the outer surface of an endless belt 18. The belt 18 extends across a support plate 20 and is mounted to a pair of rollers 22 and 24. A motor assembly 26 coupled to the rollers 22 and 24 drives the rollers so that the belt 18 is moved at a constant velocity in the direction indicated by arrow A. As the belt is moved by the rollers, the belt 18 travels across the support surface 20. The support surface 20 rigidly supports the belt 18 opposite the support assembly 16 to ensure that the polishing member 14 applies a uniform polishing force across the entire surface of the wafer. Preferably, the velocity at which the belt is moved is within the range of approximately 50 to 150 feet per minute for optimum planarization of the wafer surface. However, it is to be understood that depending upon the chemistry employed, the velocity may also be considerably faster, for example up to 300 feet per minute or more. A fluid layer, generally designated 28, between the inner surface of the belt 18 and the support plate 20 reduces frictional losses and minimizes heat dissipation during operation of the linear polisher 10. The fluid layer 28 may also permit minimal deflection of the belt 18 relative to the support plate as it passes across the plate 20 to facilitate the parallel alignment of the wafer surface and the polishing member 14.

The polishing member 14 preferably extends the entire circumference of the endless belt 18 and has a width greater than the diameter of the wafer 8. However, the size of the polishing member may be varied as desired. The polishing pad 14 is affixed to the belt 18 using any suitable securement means. If the polishing member is originally rectangular in shape, the overlapping edges of the polishing member 14 are tapered so that the wafer 8 tends to press the uppermost edge of the polishing member against the underlying edge. In the present embodiment, the polishing member 14 is a pad of stiff polyurethane material, although other suitable materials may also be used. The endless belt may be formed of a metal such as stainless steel, high strength polymers such as polyethylene terephthalate resin, or other suitable flexible materials having sufficient strength to withstand the loads applied to the belt by the wafer 8. In the embodiment shown in FIGS. 1–3, the endless belt 18 is carried by two rollers 22 and 24. However, it is to be understood that the number of rollers may be increased as desired. The rollers 22 and 24 retain the belt 18 under tension so that the polishing member 14 is sufficiently rigid to uniformly polish the surface of the wafer. The tension of the belt may be increased or decreased as necessary by adjusting the position of roller 24 relative to roller 22.

The support assembly 16 retains the wafer 8 in position during the polishing operation. In the embodiment shown in FIGS. 1–3, the support assembly 16 also maximizes the parallel alignment between the wafer surface 9 and the polishing member 14 and applies a downward force pushing the wafer surface 9 against the polishing member 14 so that the polishing member 14 applies the required polishing force across the surface of the wafer. As shown particularly in FIG. 2, the support assembly 16 includes a wafer holder 34 for supporting the wafer 8 and accurately aligning the wafer surface 9 with the polishing member 14. The wafer holder 34 has a lower plate 36 formed with a disc-shaped recess shaped to receive the wafer 8 with the wafer surface 9 projecting slightly from the lower plate 36. The wafer 8 is held in place by a backing film, waxing or another suitable technique. The lower plate 36 is affixed to a spherical-shaped journal 40 supported in a bearing 42. In the present embodiment, the clearance spacing between the journal 40 and the bearing 42 is filled with a lubricant such as water, another slurry compatible liquid or a suitable gas. The lubricant-filled cavity is coupled to a reservoir (not shown) in which a supply of lubricant is retained under pressure to provide a hydrostatic bearing in which the journal 40 is completely isolated from the bearing 42 at all times.

The spherical curvature of the journal 40 and bearing 42 provides a pivotal support for the wafer 8 which retains the wafer surface 9 at an orientation parallel to the surface of the polishing member 14 regardless of the shear forces applied to the wafer surface during the polishing process. In the present embodiment, the journal 40 is shaped in the form of a slab or section of a sphere having a center located at pivot point 46 located on the surface 9 of the wafer as shown in FIGS. 1 and 2. In other words, the shape of the journal 40 may be obtained by sectioning the sphere into two hemispheres and then removing a slice having the same thickness as the wafer from the planar surface of one of the hemispheres. This ensures that the pivot point 46 is located on the surface of the wafer. As shown in FIGS. 1 and 2, a section may optionally be removed from the opposite end of the hemisphere to reduce the height of the journal 40.

The journal 40 pivots within the bearing 42 to provide the wafer surface 9 and the polishing pad 14 with a substantially parallel orientation throughout the polishing operation. The journal 40 pivots about the pivot point 46 so that the surface of wafer having a tapered thickness is parallel to the polishing member 14. The journal also accommodates variations in the thickness of the belt 18 and polishing member 14 so that the parallelism between the wafer surface 9 and the polishing member 14 is maintained. When the wafer surface is positioned against the moving polishing belt 14, shear frictional forces are applied across the wafer surface. Since the frictional forces applied to the wafer essentially pass through the pivot point 46, the frictional forces will not cause the journal 40 to pivot relative to the bearing 42. Instead, the journal 40 continues to position the wafer with the wafer surface 9 parallel to the polishing member 14. Thus, by positioning the pivot point of the journal 40 on the wafer surface 9, the wafer holder 34 of the invention maintains the parallelism between the wafer surface 9 and the polishing member 14 so that the entire wafer surface may be uniformly polished.

As the wafer is polished and the thickness of the wafer is reduced, the pivot point 46 become displaced from the surface of the wafer. Often, the change in wafer thickness is so small that the parallel alignment of the wafer surface and the polishing member 14 will not be significantly affected. However, if greater precision is required, journal 40 may be formed with a wedge shaped section (not shown). As the wafer thickness is reduced, the wedge shaped section slides relative to the remainder of the journal to maintain the wafer surface at the center of the sphere or pivot point 46. Depending upon the vibrational effect of the polishing machine 10, it may also be desirable to include a closed-loop control system (not shown) to provide damping since the journal 40 and bearing 42 are substantially frictionless.

The wafer holder 34 is mounted to a horizontally extending upper platform 48 positioned above the support plate 20 of the linear polisher 12. The upper platform 48 is carried by a vertically extending back plate 50. The back plate 50 is pivotally mounted to the linear polishing assembly 12 by a transversely extending pivot bar 52. The support assembly 16 may be easily moved away from the polishing member 14, endless belt 18 and support plate 20 for insertion and removal of the wafer or maintenance of the support assembly or linear polisher by pivoting the assembly 16 about the bar 52.

Figure 4B:
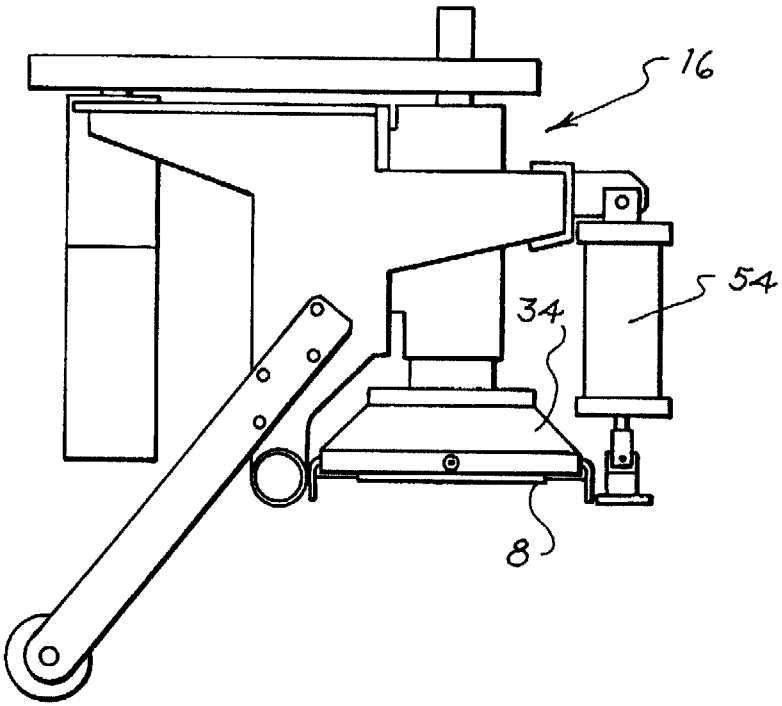
FIGS. 4A and 4B are schematic side views showing the support assembly is a raised position and a lowered position.
Figure 4A:
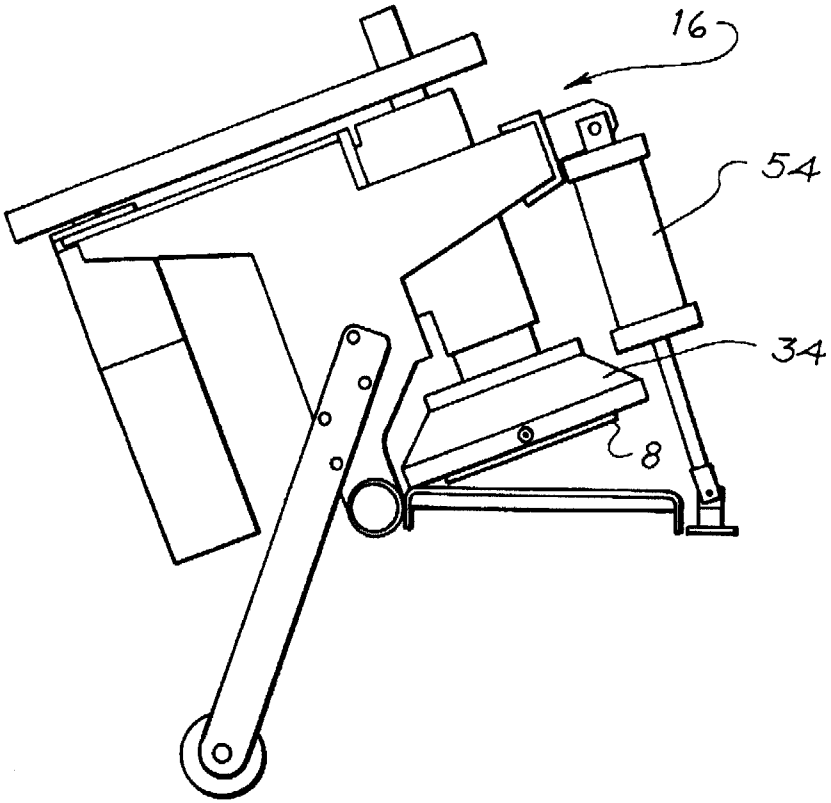

The upper platform 48 of the support assembly 16 is coupled to the linear polisher by a pneumatic cylinder 54. When the pneumatic cylinder is actuated, the cylinder 54 urges the platform 48 toward the support plate 20 to press the wafer 8 against the polishing member 14 of the linear polisher. FIGS. 4A and 4B schematically show the support assembly 16 in a raised position and a lowered position, respectively. By moving the upper platform 48 downward, the required polishing force is applied to the surface of the wafer for planarizing the wafer surface. The magnitude of the polishing force applied to the wafer surface 9 may be precisely controlled by controlling the operation of the pneumatic cylinder 54. In other embodiments of the invention, a hydraulic cylinder or other device may be used instead of the pneumatic cylinder 54 to move the upper platform 48 toward the support plate 20.

Preferably, the support assembly 16 slowly rotates the wafer 8 relative to the polishing member as the polishing member 14 is moved in linear direction. When the polishing member 14 engages the wafer 8, polishing pathways are formed on a microstructural level. Slow rotation of the wafer allows for polishing to occur at random incidence (i.e. in random directions), an important factor in defining geometric structures with polishing and preventing the formation of defined scratches in the polished surface. With most surface configurations, it is generally desirable to provide the pathways with random trajectories. Slowly rotating the wafer also varies the location of the leading edge to obtain uniform polishing along the edge of the wafer. In the present embodiment, the wafer holder 34 is slowly rotated relative to the polishing member 14 by a motor (not shown) at a slow rate. The rate of rotation of the wafer holder 34 is less than 1/10 of the speed of the belt 18 and is selected so that the wafer undergoes a number of full revolutions during the polishing operation to achieve uniform polishing. At a minimum, the wafer be rotated for a full rotation during the polishing process. Rotating the wafer for less than a full revolution may provide the wafer surface with a non-uniform profile.

The uniform polishing rate applied across the wafer surface by the linear motion of the polishing member 14 and the parallelism achieved between the wafer surface 9 and the polishing member 14 allows for uniform polishing with increased precision. This is of particular advantage in the processing of semiconductor wafers, where one may wish to remove one micron from a film having a thickness of two microns.

Figure 5A:
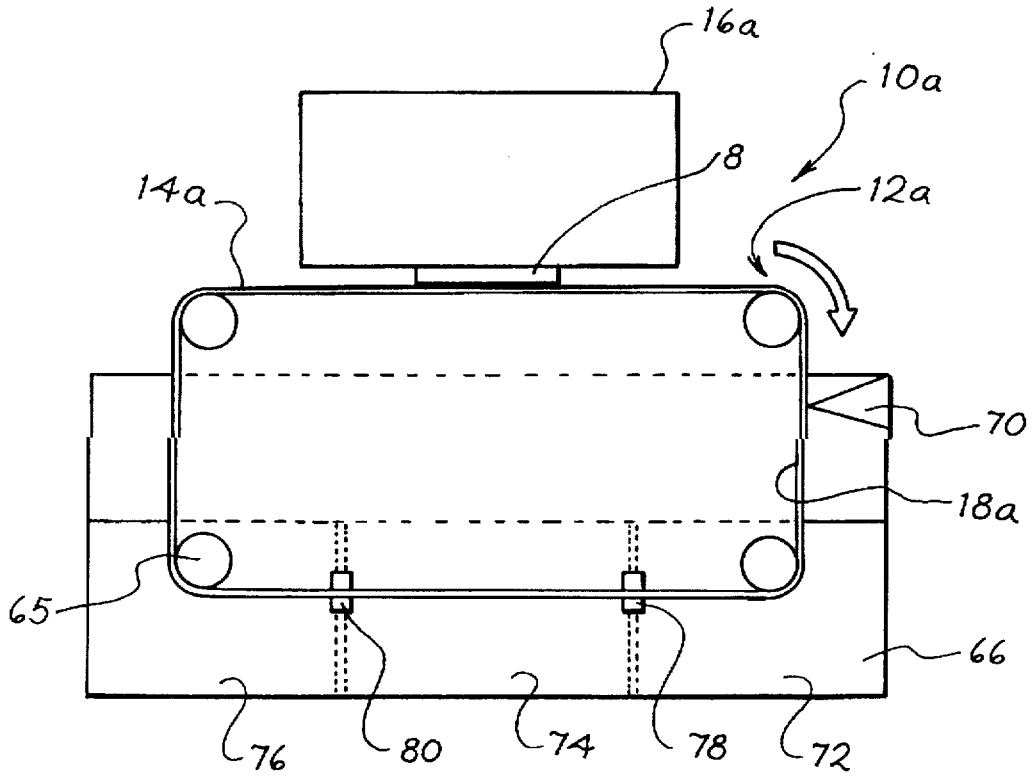
FIGS. 5A and 5B are schematic views of a wafer polishing machine in accordance with another embodiment of the invention.
Figure 5B:
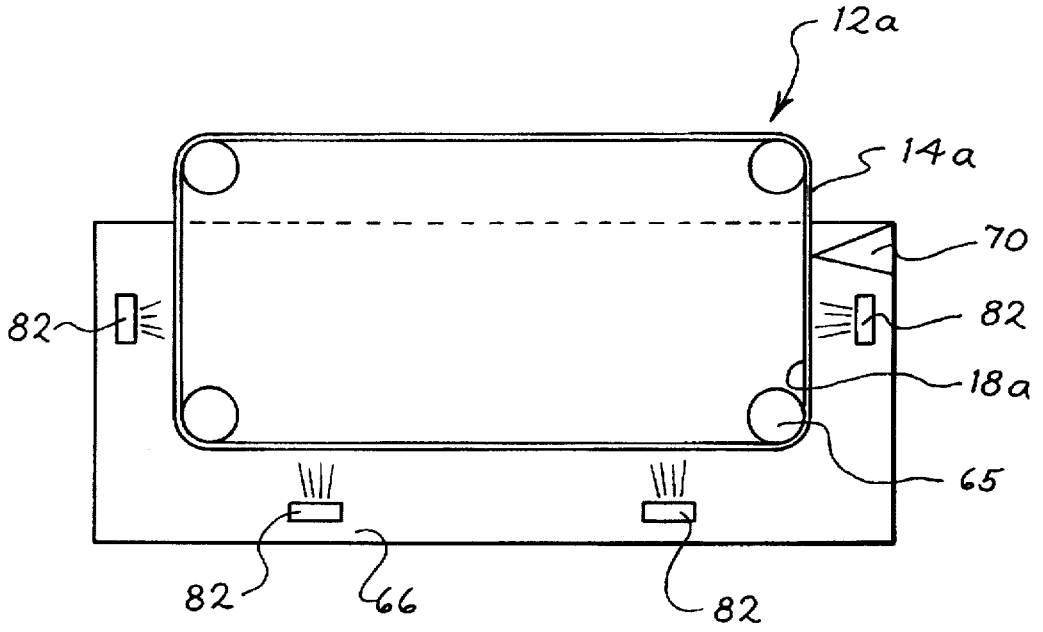

A wafer polishing machine **10*a* in accordance with another embodiment of the invention is shown schematically in FIGS. 5A and 5B. Referring particularly to FIG. 5A, the polishing machine 10*a* generally includes a linear polisher 12*a* having a polishing member 14*a* mounted co an endless belt 18*a* which is carried by a plurality of rollers 65. The semiconductor wafer is retained by a support assembly 16*a* with the surface of the wafer positioned to engage the polishing member 14*a*. The belt 18*a* moves the polishing member 14*a*** in a linear direction relative to the wafer to uniformly polish the surface of the wafer.

As the polishing member **14*a* polishes the wafer surface 9, used slurry collects within the pores in the polishing material and reduces the roughness of the polishing member 14*a*. The polishing member must be periodically conditioned to remove the deactivated slurry and roughen the polishing member 14, thereby maximizing the effectiveness of the polishing member 14*a* in uniformly planarizing the wafer surface. In the embodiment shown in FIGS. 5A and 5B, the linear polisher 12*a* includes a conditioning station 66 for conditioning the polishing member 14*a* during the polishing cycle. After a given section of the polishing member 14*a* passes across the wafer surface, it travels through the station 66 where it is conditioned before returning to the wafer surface 9. With the conditioning station 66, the wafer surface is continuously exposed to a freshly conditioned section of the polishing member 14*a***. Using a continuously conditioned pad to polish the semiconductor wafer provides greater control over the planarization process and ensures that the wafer surface is continuously exposed to a uniform polishing force.

In the embodiment shown in FIG. 5A, the conditioning station 66 includes a scraping member 70 such as a diamond conditioning block positioned to engage the surface of the polishing member **14*a* after it leaves the wafer. The scraping member 70 removes loose slurry and other loose particles from the member 14a and roughens the surface of the polishing member. The polishing member 14a then passes through an acid bath 72, a rinse bath 74 and a slurry bath 76 for further conditioning. The acid bath 72 contains an acidic solution such as diluted hydrofluoric acid solution to remove the remainder of the deactivated slurry from the polishing member 14a. The rinse bath 74 is filled with a rinsing solution such as distilled water for removing any traces of the acidic solution from the polishing member. Fresh slurry, such as a colloidal silica dispersion, is applied to the polishing member 14a in the slurry bath 76. The belt 18a travels past the scraping member 70 and enters the acid bath 72. From the acid bath 72, the belt 18a passes through a first seal 78 into the rinse bath 74 and through a second seal 80 into the slurry bath 76. The seals 78 and 80 substantially prevent intermixing of the contents between the adjacent baths 72, 74 and 76. After the belt 18a leaves the slurry bath 72, the freshly conditioned polishing member 14a** is passed across the wafer to polish the wafer surface.

The scraping member 70 and the series of the baths 72, 74 and 76 illustration one configuration of a conditioning station which is particularly suitable for conditioning the polishing member 14a during operation of the wafer polishing machine 10a. However, it is to be understood that other embodiments of the invention are subject to considerable modification. For example, instead of seals 78 and 80 separating the acid bath 72, rinse bath 74 and slurry bath 76, additional rollers may be provided to direct the belt into the individual baths. The number of baths provided in the conditioning station may be increased or decreased as desired. Instead of baths, the conditioning system may employ nozzles 82 as shown in FIG. 5B for spraying cleaning agents, rinsing agents and/or slurry on the polishing member 14a. Further, the conditioning system may include a combination of baths and spray injection nozzles.

Figure 6:
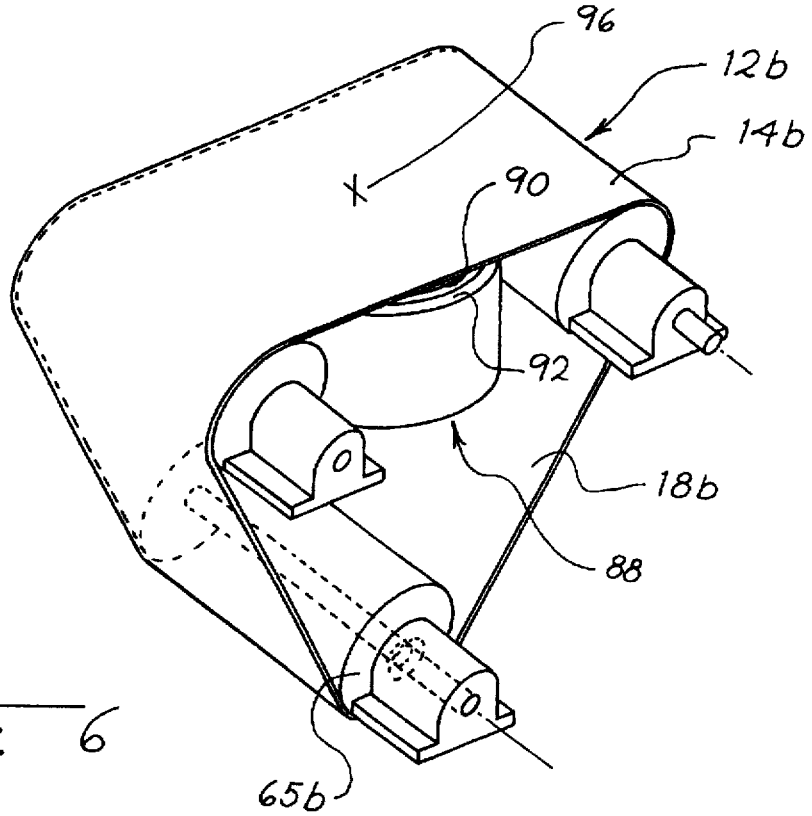
FIG. 6 is a perspective view of a linear polisher of a wafer polishing machine in accordance with another embodiment of the invention.
Figure 7:
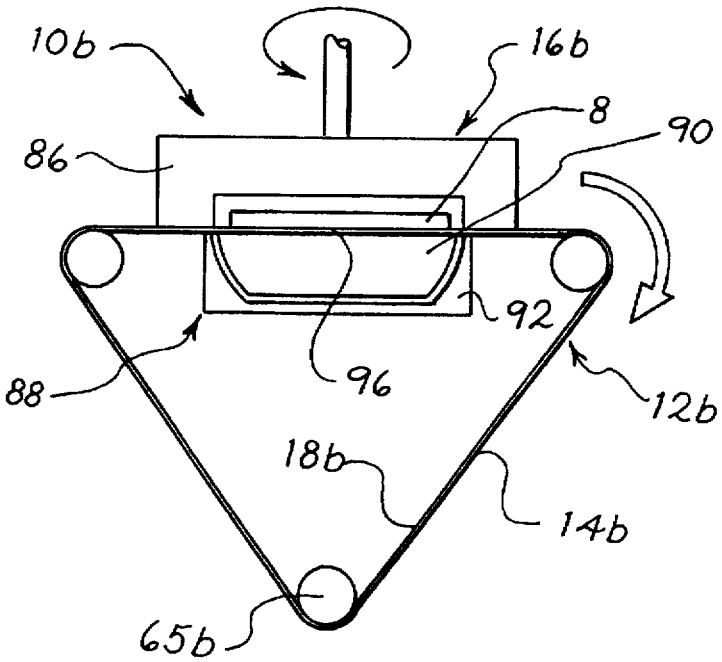
FIG. 7 is a schematic view of the wafer polishing machine of FIG. 6.

FIGS. 6 and 7 illustrate another embodiment of a linear polisher 12b in accordance with the invention. The polishing machine 10b includes a linear polisher 12b having a polishing member 14b carried by an endless belt 18b and a support assembly 16b (FIG. 7) for supporting a semiconductor wafer. As shown in FIG. 7, a wafer holder 86 mounted to the support assembly 16b rigidly supports the semiconductor wafer during the polishing operation. A gimballed support 88 positioned beneath the belt 18b supports the belt 18b and applies an upward force to the belt to press the polishing member 14b against the wafer for polishing the wafer surface. The gimballed support 88 also aligns the belt 18b with the polishing member 14b parallel to the wafer surface so that a uniform polishing force is applied across the entire surface of the wafer.

In the embodiment shown in FIGS. 6 and 7, the construction of the gimballed support 88 is substantially similar to the wafer support 34 shown in FIGS. 1–3. The gimballed support 88 includes a spherical shaped journal 90 supported in a hydrostatic bearing 92. The clearance space between the journal 90 and the bearing 92 is filled with a lubricant such as water, another slurry compatible liquid or a suitable gas. A reservoir (not shown) retaining lubricant under pressure supplies the clearance space with lubricant to ensure that the journal is constantly separated from the interior of the bearing. The journal 90 has a planar support surface which engages the underside of the belt and presses the polishing member 14b against the wafer surface.

As shown in FIG. 7, the journal 90 is formed in the shape of a section of a sphere which has a center at pivot point 96 positioned on the exterior of the polishing member 14b. The journal pivots within the bearing 92 about the pivot point 96 to maintain the parallelism between the wafer surface 9 and the polishing member 14b. As the polishing member 14b polishes the wafer surface, shear frictional forces are applied to the polishing member by the wafer surface. Since the frictional forces essentially pass through the pivot point 96, the frictional forces will not cause the journal 90 to pivot relative to the wafer surface. Thus, the parallelism between the surface of the wafer and the polishing member 14b is continuously maintained while the wafer surface is polished.

Figure 8:
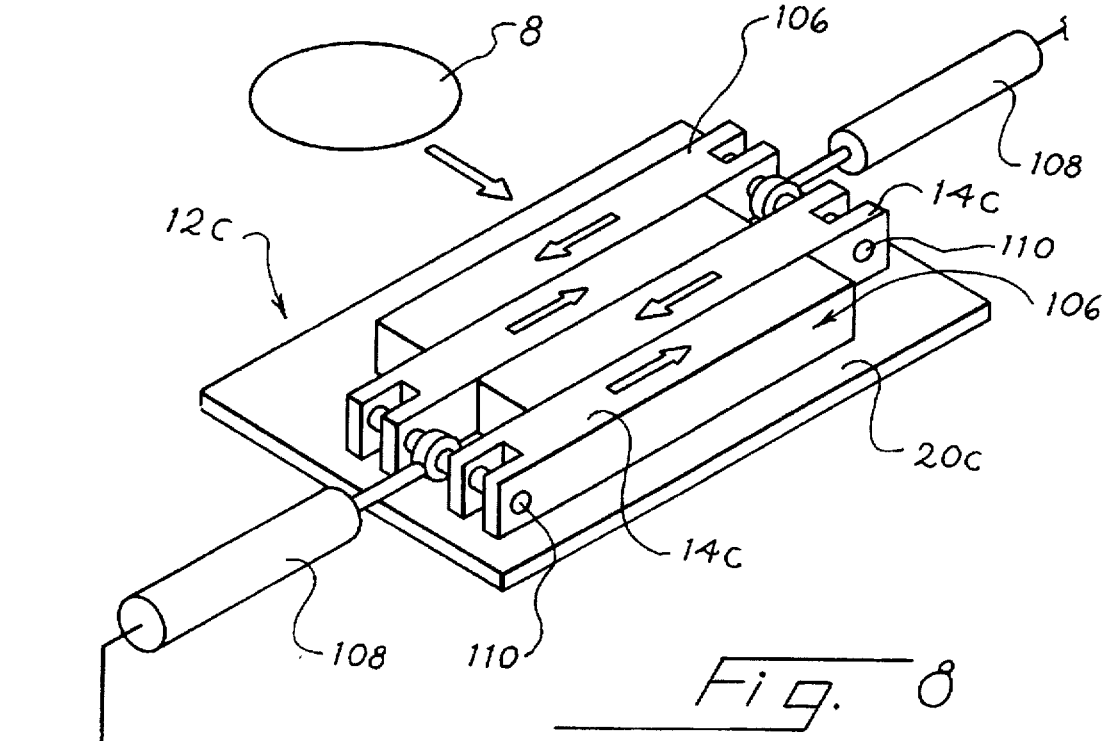
FIG. 8 is a perspective view of a linear polisher in accordance with still another embodiment of the invention.

Instead of the endless belt of the previously described embodiments, other apparatus may be used to move the polishing member in a linear direction. FIG. 8 shows a linear polisher 12c having a plurality of parallel reciprocating bars 106 positioned on a support plate 20c. A polishing member 14c is mounted to each of the reciprocating bars 106 for polishing the surface of the semiconductor wafer 8. Although not shown, the bars 106 may be positioned in a slurry bath to ensure that sufficient slurry is applied to the polishing members 14c. Alternatively, the bars 106 may be inverted and suspended above the wafer and the slurry applied to the wafer surface. An actuating device such as pneumatic cylinders 108 coupled to the reciprocating bars by pins 110 move the bars in a linear direction across the support plate 20c. Although not shown, the bars 106 may be carried by linear slides or a linear motor. Preferably, the bars 106 are divided into two groups which are simultaneously moved in opposite directions by the pneumatic cylinders 108. As shown in FIG. 8, the linear polisher 12c includes four reciprocating bars with each bar 106 moving in an opposite direction from adjacent bars. However, it is to be understood that the number of reciprocating bars may be increased or decreased as desired and that numerous other configurations may be employed. Further, additional pneumatic cylinders may be used to independently move the reciprocating bars.

The pneumatic cylinders 108 move the reciprocating bars 106 back and forth relative to the semiconductor wafer, with the stroke of the bars 106 preferably being approximately equivalent to the diameter of the wafer plus two times the length of the reciprocating bars so that with each stroke the bar moves beyond the wafer surface. Alternatively, the reciprocating bars may oscillate so that the bar is continuously in contact with the wafer surface. The reciprocating bars 106 have greater rigidity than the endless belt of the previously described embodiments, providing a more stable system. The velocity of the reciprocating bars 106 is controlled by a control system 112 coupled to the pneumatic cylinders 108. The control system 112 is preferably configured to actuate the cylinders and drive the reciprocating bars 106 at a constant velocity. The constant velocity, linear motion of the polishing members 14c uniformly polishes the surface of the wafer. However, with some surface configurations it may be desirable to move the polishing members 14c in a non-uniform velocity profile. With the present embodiment, the control system may be configured to actuate the pneumatic cylinders 108 in accordance with a specific velocity profile to move the polishing members 14c at the required non-uniform velocity for uniform polishing. Although pneumatic cylinders 108 are employed in the present embodiment, other devices such as hydraulic cylinders, cams, stepping motors used with a ball screw etc., servomotors, linear motors, etc. may also be used to move the reciprocating bars 106.

The wafer 8 is preferably supported by the support assembly 16 shown in FIGS. 1–3 with the pivotal movement of the wafer within the wafer holder 34 positioning the wafer surface 9 parallel to the surface of the polishing members 14c. As described above in relation to FIGS. 1–3, the wafer holder 34 may rotate the wafer 8 relative to the polishing members 14c to uniformly planarize localized regions of the wafer surface. Alternatively, with some surface configurations uniform planarity may be obtained without rotating the wafer. Although not shown, the support assembly 16 may be mounted for movement in a transverse direction relative to the reciprocating bars to move the wafer 8 transversely across the surface of the polishing members 14c.

Figure 9:
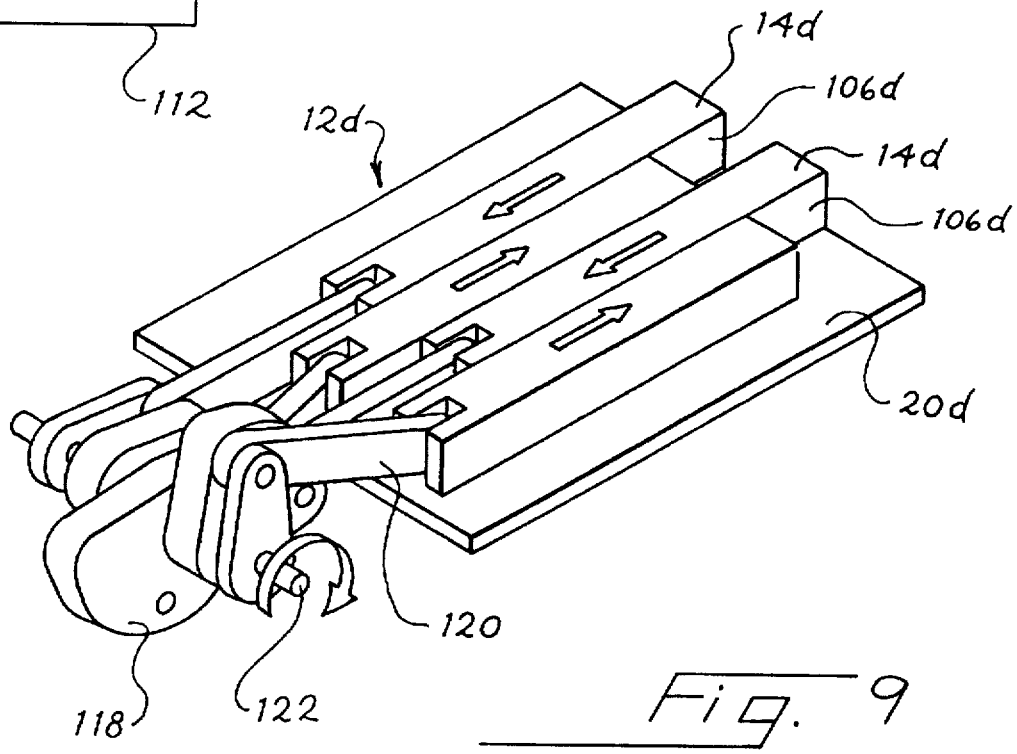
FIG. 9 is a view similar to FIG. 8 of a linear polisher in accordance with another embodiment of the invention.

The linear polisher 12d shown in FIG. 9 includes a plurality of reciprocating bars 106d which are moved across a support plate 20d by a crank assembly 118. Polishing members 14d are mounted to the reciprocating bars 106d for polishing the surface of the wafer. The crank assembly 118 includes a plurality of crank arms 120 each coupled to a crank shaft 122 and one of the reciprocating bars. A motor (not shown) rotates the crank shaft 122, causing the crank arms 120 to move the reciprocating bars in a linear direction. As shown in FIG. 9, the crank arms 120 move adjacent reciprocating arms in opposite directions. However, in other modifications two or more adjacent bars may be moved in the same direction. The linear polisher 12d is used with the support assembly 16 shown in FIGS. 1–3, which supports the wafer and positions the wafer surface parallel to the polishing members 14d.

In the embodiment of FIG. 9, the velocity of the reciprocating bars 106d is not constant. Instead, the crank assembly 118 moves the reciprocating bars 106d at a sinusoidal velocity. Preferably, the semiconductor wafer is rotated at a variable velocity defined by the sinusoidal variations in the velocity of the polishing members 14d. With the crank assembly 118, the reciprocating bars 106d may be moved in a specific variable velocity profile to provide the desired polishing across the wafer surface.

Except as set forth above, the modifications of FIGS. 4A–4B, 5A–5B, 6–7, 8 and 9 resemble those of the preceding modifications and the same reference numerals followed by the subscripts a–d, respectively, are used to designate corresponding parts.

It is to be understood that in the foregoing discussion and appended claims, the terms "wafer surface" and "surface of the wafer" include, but are not limited to, the surface of the wafer prior to processing and the surface of any layer formed on the wafer, including oxidized metals, oxides, spun-on glass, ceramics, etc.

While the invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A wafer polishing machine for the chemical mechanical planarization of a surface of a semiconductor wafer with an abrasive polishing agent comprising:

a wafer support assembly having a wafer holder shaped to receive said wafer and support said wafer with said surface projecting from said wafer holder;

a linear polishing assembly having a polishing member positioned to engage said surface of said wafer, said polishing member being movable in a linear direction relative to said wafer to continuously apply a uniform polishing force across said surface of said wafer during operation of said wafer polishing machine for uniformly polishing said surface of said wafer, said polishing member comprising a plurality of reciprocating bars having a polishing material mounted to said bars, said bars being movable in a linear direction relative to said wafer.

2. The wafer polishing machine of claim 1 in which said polishing assembly includes at least one actuating device coupled to said bars for moving said bars in a linear direction relative to said wafer.

3. The wafer polishing machine of claim 2 in which said polishing assembly includes a control system coupled to said actuating device, which control system is configured for moving said bars in accordance with a selected velocity profile.

4. A method for uniformly planarizing the surface of a semiconductor wafer, said surface comprising at least one layer formed on the wafer, said method comprising the steps of:

supporting said wafer with said surface of said wafer engaging a polishing member adapted for chemical mechanical polishing;

rotating said wafer relative to said polishing member;

supplying a polishing slurry to the polishing member; and moving said polishing member in a linear direction relative to said wafer to chemically mechanically planarize said surface of said wafer.

5. The method of claim 4 in which said moving step includes moving said polishing member at a constant velocity within the range of 50 to 150 feet per minute.

6. The method of claim 4 in which said moving step includes moving said polishing member in accordance with a velocity profile selected to apply a uniform polishing force across said surface of said wafer.

7. The method of claim 4 which said step of rotating said wafer includes rotating said wafer at a velocity of at most approximately 1/10 the velocity of said polishing member, with the angular velocity of said wafer relative to said polishing member being uniform across said surface of said wafer.

8. The method of claim 4 in which said moving step includes moving said polishing member in a continuous path in which said polishing member passes across said surface of said wafer, and further comprising the step of conditioning said polishing member with a scraper as said polishing member travels in said continuous path.

9. The method of claim 4 which further comprises the step of pivoting one of said wafer and said polishing member relative to the other of said wafer and said polishing member until said surface of said wafer and said polishing member are substantially parallel.

10. A wafer polishing machine for the chemical mechanical planarization of a surface of a semiconductor wafer with an abrasive polishing agent comprising:

a rotary wafer support assembly having a wafer holder shaped to receive said wafer and support said wafer with said surface projecting from said wafer holder;

a linear polishing assembly having a polishing member positioned to engage said surface of said wafer, said polishing member being movable in a linear direction relative to said wafer to continuously apply a uniform polishing force across said surface of said wafer during operation of said wafer polishing machine for uniformly polishing said surface of said wafer;

wherein said polishing member comprises a metal belt and a polishing layer mounted on the belt, said belt having a width substantially greater than its thickness.

* * * * *